United States Patent [19]

Winters

[11] 3,994,458

[45] Nov. 30, 1976

[54] HOT BOX DETECTOR SYSTEM

[75] Inventor: Kenneth W. Winters, Pineville, W. Va.

[73] Assignee: Flynn, Max and Albright, Huntington, W. Va. ; a part interest

[22] Filed: Jan. 23, 1975

[21] Appl. No.: 543,621

[52] U.S. Cl. ..... 246/169 A; 116/DIG. 38

[51] Int. Cl.[2] ..... B61L 3/12

[58] Field of Search ..... 246/169 A, 246; 116/114.5, 101, 106, DIG. 38

[56] References Cited

UNITED STATES PATENTS

| | | | |
|---|---|---|---|
| 859,925 | 7/1907 | Des Isles | 116/106 |
| 2,757,361 | 7/1956 | Cameron | 246/169 A |
| 3,197,632 | 7/1965 | Baughman | 246/169 A |

*Primary Examiner*—Trygve M. Blix
*Assistant Examiner*—Reinhard J. Eisenzopf
*Attorney, Agent, or Firm*—Clarence A. O'Brien; Harvey B. Jacobson

[57] ABSTRACT

A normally inactive sound signal generator is supported from the rotatable axle of each railway car in a train and actuatable to generate a predetermined signal in response to a hot box condition. Electrically operable signal receivers coupled to electrically operable radio signal transmitters are spaced along the railroad track at predetermined intervals which may be 4,000 to 6,000 feet apart and the receivers and transmitters are operable on low magnitude current, such as provided in the rails of the track for Centralized Train Control Systems. The engine and caboose of a freight train are provided with radio signal receivers actuated by on-board current and the caboose receiver is operative to actuate visual and audible signals as well as an electrically operated air brake dump valve (through a time delay mechanism) and the engine receiver is operable to also actuate visual and audible signals and a relay (through a time delay mechanism) electrically connected to the engine electrical control system for automatically reducing the power output of the engine. If the hot box condition detected is too distant from the actuated track side radio signal generator to receive its low magnitude radio signal, then the low magnitude signal is received by the caboose mounted radio signal receiver as it passes close by the actuated trackside radio transmitter.

14 Claims, 13 Drawing Figures

Receiver Transmitter
Ultra Sonic Signal
Receiver
104
107
109
Transmitter
110
Radio Signal Caboose
Radio Signal
Receiver
112
Warning Light
124
Buzzer
126
Variable Time Delay
128
Switch
130
Electric valve
132
Train air line
134

Engine Cab
Radio Signal
Receiver
114
Warning Light
130
Buzzer
132
Variable Time Delay
136
Switch
134
Relay
138
To engine's Power system

HOT BOX DETECTOR SYSTEM

BACKGROUND OF THE INVENTION

Various different forms of hot box detecting systems have been heretofore designed. Examples of these previously known detecting systems are disclosed in U.S. Pat. Nos. 2,521,469, 2,897,775, 3,440,416, 3,546,448 and 3,790,777. Further, an alarm signal for heated bearings is disclosed in U.S. Pat. No. 859,925.

However, these previously known systems and devices are not fully capable of automatically bringing a train experiencing a hot box condition to a halt as a result of repeated monitoring of all of the bearing journals of the train and also capable of rendering both visual and audible signals in the caboose and engine of a train experiencing a hot box condition prior to automatic stopping of the train. Further, these previously known devices do not also include readily installable substantially fail-safe wheel axle mounted signal generators which are retained in inoperative fully enclosed condition until such time as they are actuated by a hot box condition.

BRIEF DESCRIPTION OF THE INVENTION

The hot box detector system of the instant invention has been constructed in a manner substantially all parts of the system are fail-safe in operation. The wheel axle mounted signal generators are readily mountable on the associated ends and fully enclosed for protection from the elements until such time as they are actuated. The trackside signal receivers and radio transmitters are operable on low amplitude current, such as is already available in the rails of the track for Centralized Train Control Systems and the train is equipped with two receivers at opposite ends of the train for receiving signals from an actuated trackside transmitter. Even though the trackside transmitters are operable on low amplitude current and are not capable of sending radio signals over great distances, the trackside transmitters are capable of transmitting signals at least several times the length of a long freight train to the engine and/or the caboose of the train in the event the hot box is detected. Further, inasmuch as the caboose mounted receiver passes closely by an actuated trackside transmitter, a signal of a magnitude which is many times greater than that which is necessary to be picked up by the caboose receiver is generated by the trackside transmitter. Still futher, should a malfunction occur in either receiver carried by the train, the other receiver will be fully capable of receiving a signal from an actuated trackside transmitter and if for any reason a trackside signal receiver or transmitter is rendered inoperative, the hot box condition actuated axle mounted sound generator will continue to generate its signal pulses until the next set of trackside signal receivers and radio transmitters is passed.

The main object of this invention is to provide a hot box detector system for railway trains which will be operative in a substantially fail-safe manner to render audible and visual signals in both the caboose and engine of the train in the event of a hot box condition and which will thereafter be operative to automatically bring the train to a halt in the event the audible and visual signals are not heeded by on-board train personnel.

Another object of this invention, in accordance with the immediately preceding object, is to provide a hot box detector system which will require, in the way of adaptation of railway cars, only the ready mounting of a relatively inexpensive mechanically operated signal generator on each end of each train car axle.

Another very important object of this invention is to provide a hot box detector system which will require only widely spaced trackside signal receiver and radio transmitter installations which are of low power and may be fully actuated by low magnitude current such as that provided in the rails of tracks under the control of Centralized Train Control Systems.

A final object of this invention to be specifically enumerated herein is to provide a hot box detector system in accordance with the preceding objects and which will conform to conventional forms of manufacture, be of simple construction and automatic in operation so as to provide a device that will be economically feasible, long lasting and relatively trouble free in operation.

These together with other objects and avantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
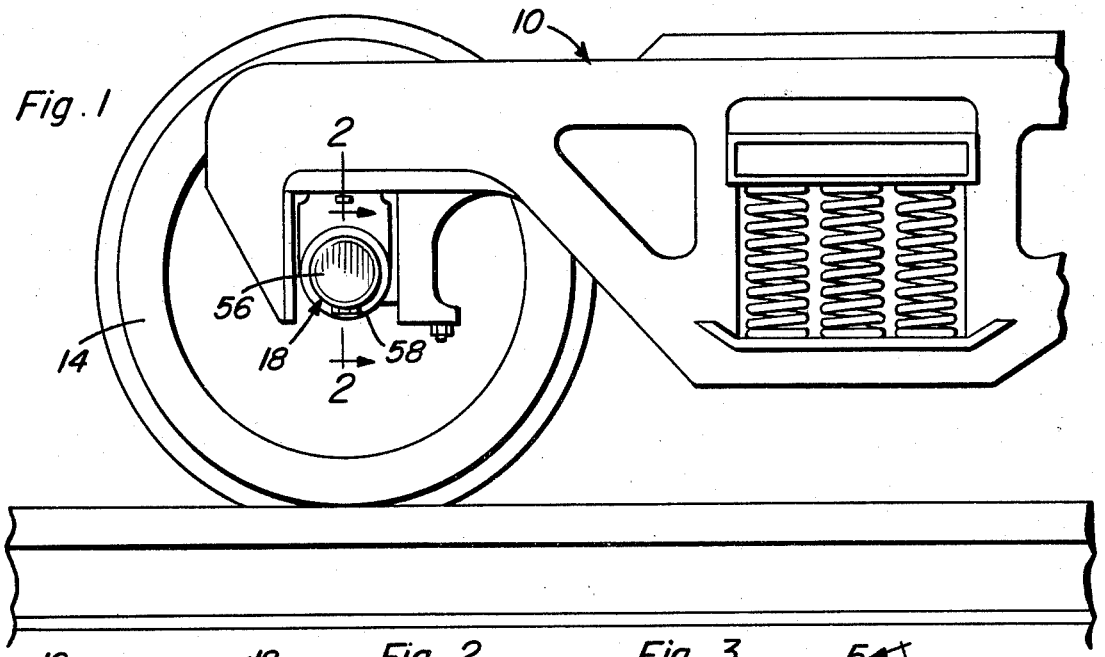
FIG. 1 is a fragmentary side elevational view of a train car truck with the mechanically actuated signal generator portion of the instant invention supported from the near end of the wheel axle in an inoperative condition.

Referring now to more specifically to the drawings, the numeral 10 generally designates a railway car truck from which an axle and wheel assembly 12 are journalled by means of suitable bearings (not shown).

The assembly 12 conventionally includes opposite end portions 13 which project endwise outwardly beyond the corresponding wheels 14 and the outer ends of the portions 13 include threaded blind bores 16 which are provided for the utilized in the machining of the assembly 12 during its manufacture.

The numeral 18 generally designates a mechanical sound generator. Generator 18 includes a disk-shaped body 20 having a central coupling 22 journalled therefrom by means of a bearing assembly 24. The bearing assembly 24 includes an externally threaded nipple 26 threaded into the corresponding blind bore 16.

The coupling 22 has a central bore 28 formed therethrough and the outer end of the bore 28 is provided with a diametrically enlarged counterbore 30 while the inner end of the bore 28 is provided with a diametrically enlarged counterbore 32.

A sleeve 34 is snugly seated in the counterbore 30 and has a central bore 36 formed therethrough. In addition, a sleeve 38 is secured in the counterbore 32.

An operating shaft or plunger 40 extends through the bore 36 and the bore 28 and is slightly smaller in diameter than the bore 28. The inner end of the shaft 40 is reduced and threaded and has a tapered head 42 threaded thereon. The head 42 is disposed generally centrally lengthwise in the sleeve 38 and is secured in position by means of a fusable material 44. A compression spring 46 is disposed about that portion of the shaft 40 between the sleeve 34 and the head 42 and tends to bias the shaft 46 to the left relative to the sleeve 34 as viewed in FIG. 2.

The outer end of the shaft 40 projects outwardly from the sleeve 34 and a centrally bored cam disk 48 is secured to the outer end face of the sleeve 34 by means of fasteners 50 and includes a radially outwardly projecting cam lobe 52. In addition, the outer face of the cam disk 48 has an off-center blind bore 54 formed therein.

Figure 2:
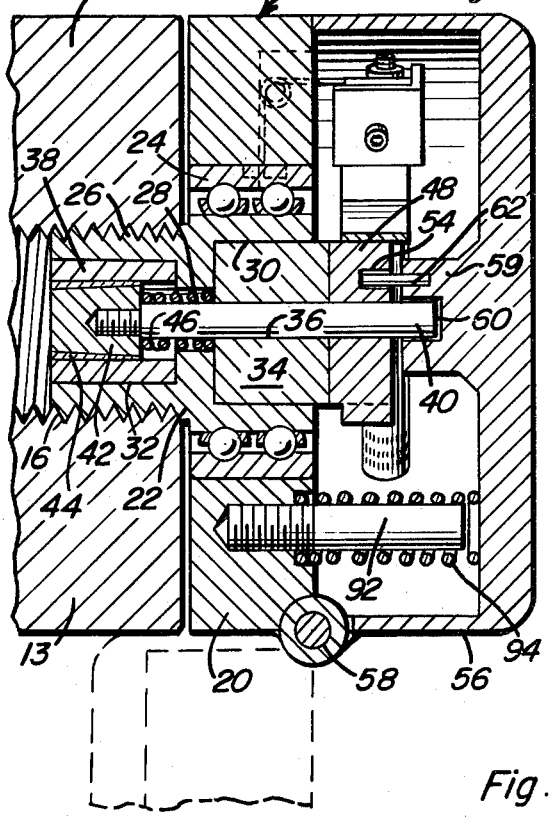
FIG. 2 is an enlarged fragmentary vertical sectional view taken substantially upon the plane indicated by the section line 2—2 of FIG. 1.

A cup-shaped cover 56 is hinged at one side thereof to a corresponding side of the body 20 as at 58 and is swingable from the closed solid line position thereof illustrated in FIG. 2 of the drawings completely enclosing the outer face of the body 20 and the open position thereof illustrated in phantom lines in FIG. 2. The cover 56 includes an inner central boss 59 having a central blind bore 60 formed therin in which the outer end of the shaft 40 is snugly received when the cover 56 is in the closed position and which prevents the cover 56 from swinging from the closed position to the open position thereof. In addition, the boss 59 further includes an outwardly projecting pin 62 which is eccentrically positioned relative to the blind bore 60 and is receivable in the blind bore 54 in the cam disk 48 in order to lock the cover 56 and thus the body 20 against rotation relative to the coupling 22 and the sleeve 34.

When the generator 18 is installed on the end of the axle portion of the assembly 12 in the manner illustrated in FIG. 2 of the drawings, the cover is locked against rotation relative to the assembly 12.

A first mount 64 is mounted on the outer face of the body 20 by means of suitable fasteners 66 and supports one end of a spring arm 68 therefrom. The other end of the spring arm 68 adjustably supports a spring actuator abutment 70 therefrom and the outer face of the body 20 has a second mount 72 supported therefrom by means of fasteners 74 and adjustably supports a sounding body or rod 76 therefrom which is in the form of an elongated cylindrical rod 76. The rod 76 is supported from the mount 72 by means of a mounting block portion 78 of the mount 72 from which the sounding rod 76 is supported by three set screws 80, 82 and 84. Also, the outer face of the body 20 includes a recess 85 formed therein in which one end of a butterfly spring is anchored by means of an anchoring pin 88. The outer end of the spring 86 adjustably supports a striker member 90 therefrom for engagement with the adjacent end of the sounding body 76.

In operation, the signal generator 18 is mounted on the axle assembly 12 in the manner illustrated in FIG. 2 of the drawings with the cover 56 retained in the closed position by means of the shaft 40. When the cover 56 is closed, the pin 62 is seated in the counterbore 54 and thereby locks the body, from which the cover 56 is supported, against rotation relative to the cam disk 48, the latter being supported from the sleeve 34 and the sleeve 34 being securely mounted within the counterbore 30 formed in the coupling 22 which is in turn fully tightened in the threaded blind bore 16 for rotation with the assembly 12.

If the bearings which journal the assembly 12 become overheated, a considerable portion of the heat generated at the bearing is transmitted through the assembly 12 to the inner end of the blind bore and the fusable material 44 melts whereby the spring 46 shifts the shaft 40 to the left as viewed in FIG. 2 of the drawings to the inner end of the blind bore 16, thereby retracting the outer end of the shaft 40 from the blind bore 60. This, of course, releases the cover 56 whereby the latter may swing from its closed position illustrated in solid lines in FIG. 2 of the drawings to the open position thereof illustrated in phantom lines in FIG. 2. In order to insure that the cover 56 will open the shaft 40 is retracted from the blind bore 60, the body 20 supports an outwardly projecting mounting shank 92 about which a strong compression spring 94 is disposed. The compression spring 94 is disposed about the shank 92 between the outer face of the body 20 and the inner face of the cover 56 and thereby strongly biases the cover 56 toward the open position when the shank 40 is axially withdrawn from the blind bore 60.

Figure 3:
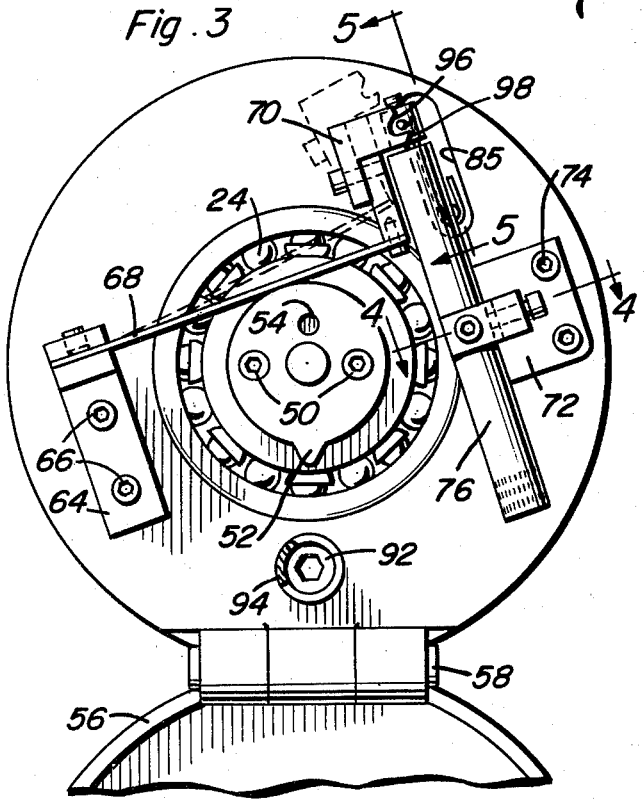
FIG. 3 is a side elevational view of the signal generator in an operative condition and as seen from the right hand side of FIG. 2.
Figure 4:
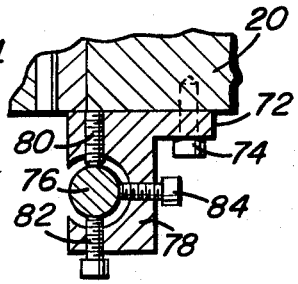
FIG. 4 is an enlarged fragmentary sectional view taken substantially upon the plane indicated by the section line 4—4 of FIG. 3.
Figure 5:
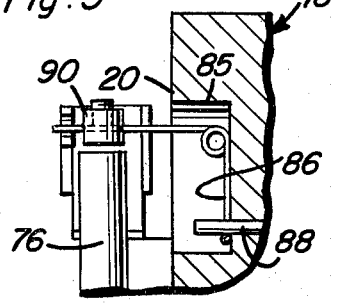
FIG. 5 is an enlarged fragmentary sectional view taken substantially upon the plane indicated by the section line 5—5 of FIG. 3.
Figure 6:
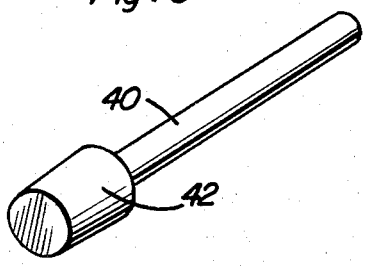
FIG. 6 is a prespective view of the fusable llink and the associated actuating plunger of the signal generator which retains the signal generator in an inoperative condition.

As the cover 56 is swung to the open position, the lateral displacement of the cover 56 from its central closed position to its open position causes the body 20 to be eccentrically weighed. Therefore, the cover 56 swings to a depending open position and the eccentric weighting of the body 20 retains the latter in position with the cover 56 disposed lowermost. Then, as continued rotation of the assembly 12 occurs while the body 20 is retained motionless, the cam lobe 52 successively bends the free end of the spring arm 68 to the phantom line position thereof illustrated in FIG. 3 and thus elevates the outer end of the spring 86 from which the member 90 is supported. As the spring arm 68 has its free end biased away from the center axis of rotation of the cam disk 48, the free end of the spring 86 slips from the notch 96 formed in the member 70 and the resiliency of the spring 86 causes the member 90 to strike the end of the sounding body 76. Of course, as the spring arm 68 returns to the solid line position thereof illustrated in FIG. 3 of the drawings, it may be seen that the member 70 includes a cam surface 98 which biases the free end of the spring 86 laterally so that the free end of the spring 86 may again be positioned within the notch 96 for subsequent actuation by the cam lobe 52.

It may, therefore, be seen that when the cover 56 is swung to the open positions, the generator 18 is capable of successively generating a sound signal and it is to be understood that the sounding body 76 will be of such construction to generate a sound signal in a limited frequency range which is not normally associated with movement of a railway car.

Figure 7:
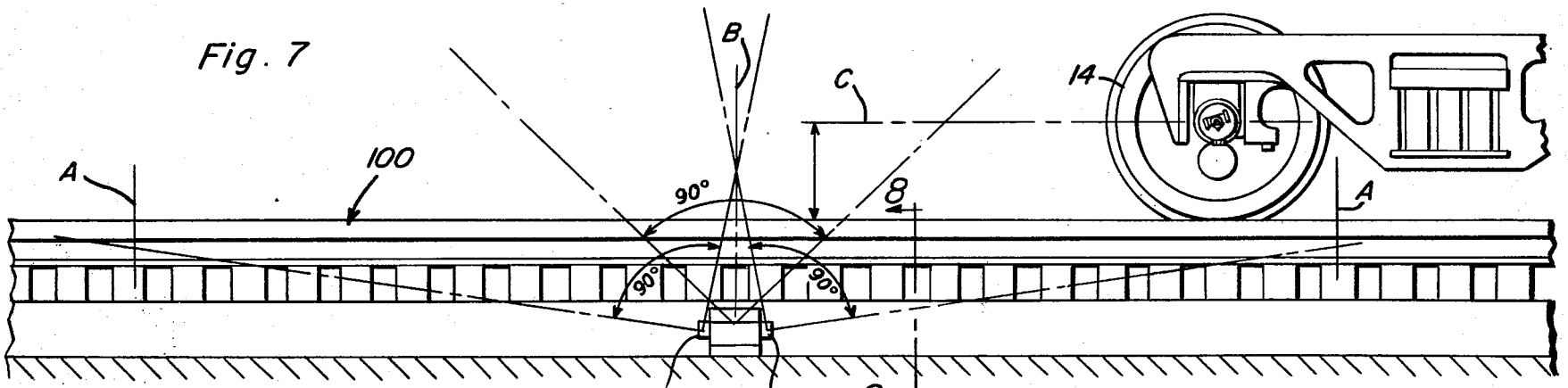
FIG. 7 is a fragmentary side elevational view of a trackside signal receiving and radio signal transmitting station.
Figure 9:
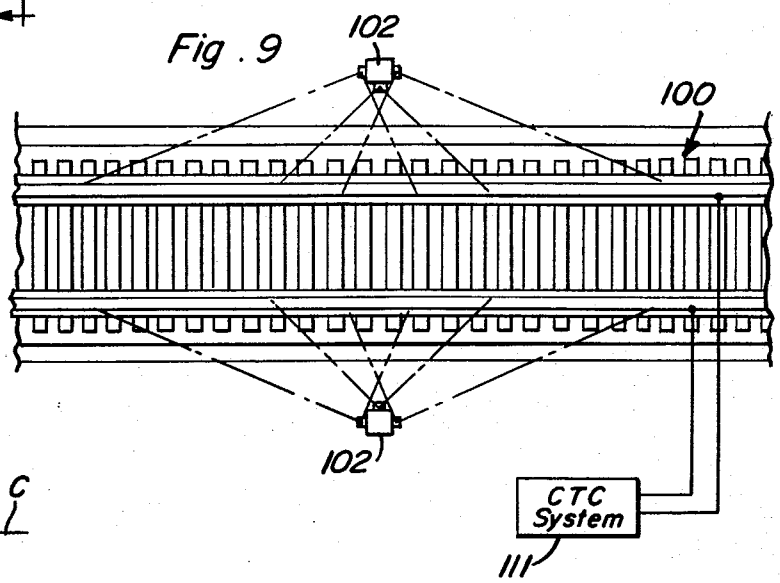
FIG. 9 is a top plan view of the assemblage illustrated in FIGS. 7 and 8 on somewhat of a reduced scale.
Figure 8:
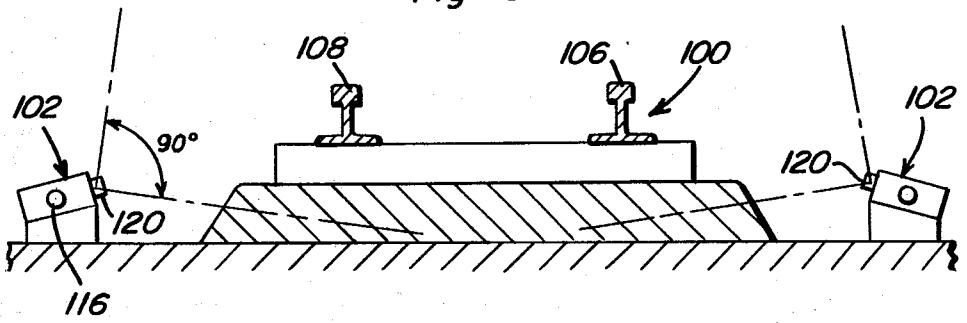
FIG. 8 is a transverse vertical sectional veiw taken substantially upon the plane indicated by the section line 8—8 of FIG. 7.

With attention now invited more specifically to FIGS. 7 through 9 of the drawings, it may be seen that the railway track referred to in general by the reference numer 100 has a trackside installation referred to in general by the reference numeral 102 disposed on opposite sides thereof. Further, it is to be understood that the track 100 will be provided with pairs of opposite side installations 102 at intervals spaced along the track 100. The spacing betweem adjacent pairs of installations 102 may be on the order of 4,000 to 6,000 feet.

Figures 11, 12, 13:
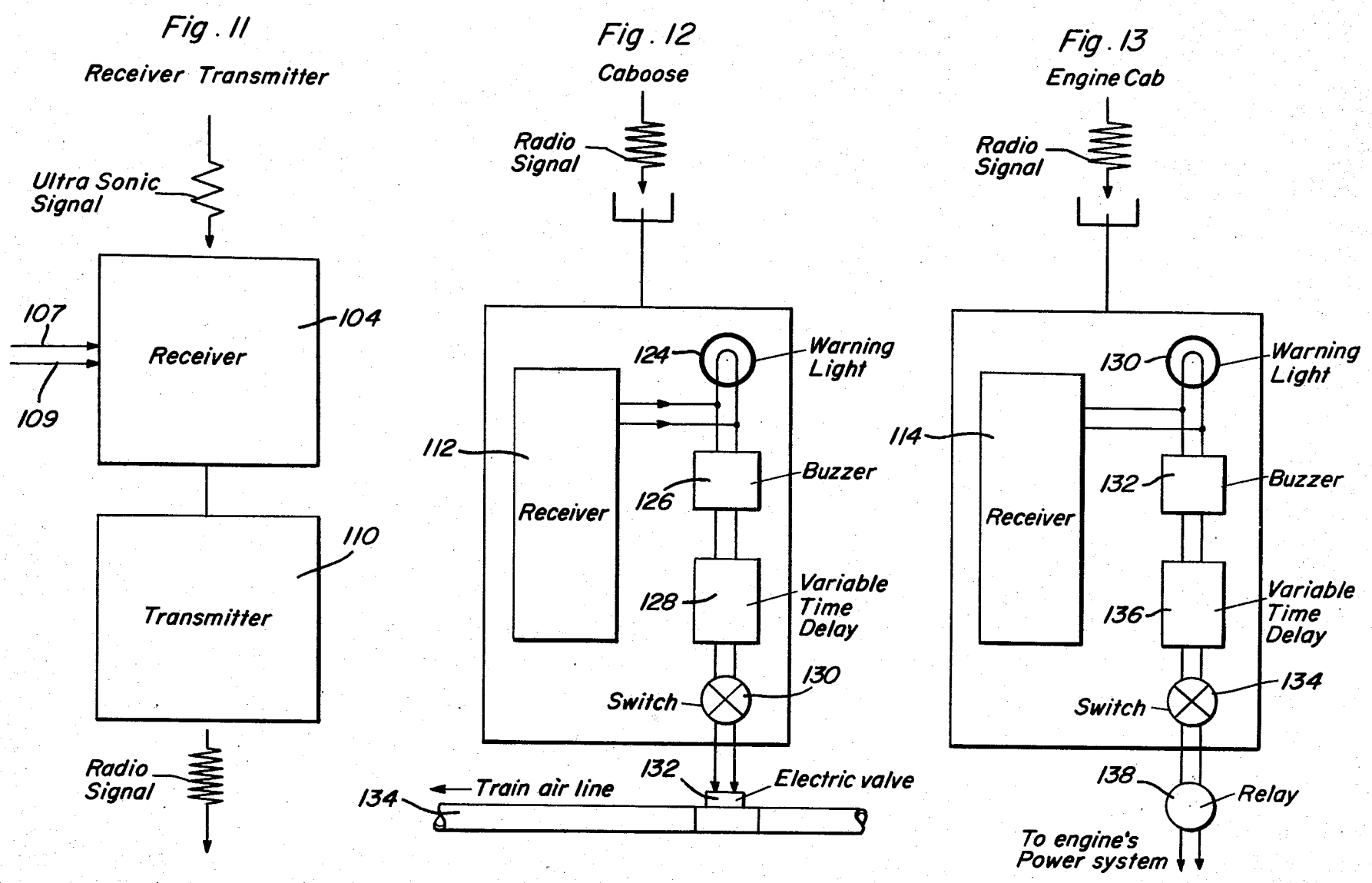
FIG. 11 is a schematic view of one of the trackside installations.
FIG. 12 is a schematic view of the caboose mounted portion of the system and illustrating the manner in which it is operatively connected to the air brake line of the train.
FIG. 13 is a schematic view of the engine mounted portion of the system and illustrating the manner in which it is electrically connected to the engine's power sytem.

Each installation 102 comprises a sound signal receiver 104, see FIG. 11, and the receiver 104 is constructed so as to be electrially operated by low magnitude current taken directly from the rails 106 and 108 of the track 100 by conductors 107 and 109, the track 100 having its rails 106 and 108 provided with low magnitude current as a part of the conventional Centralized Train Control System 111.

The receiver 104 is electrically coupled to a radio transmitter 110 which is also operable from low magnitude current taken from the track 100 and the transmitter 110 is capable of developing a low magnitude radio signal which may be received by a receiver 112 in the caboose of a passing train, see FIG. 12, or a receiver 114 in the engine of a passing train, see FIG. 13.

Each receiver 104 is provided with three microphones 116, 118 and 120 each having a cone of reception of generally 90° and the microphones are oriented relative to the track 100 in the manner illustrated in FIGS. 7, 8 and 9 of the drawings. From FIG. 8 of the drawings, it will be seen that the microphones are angled upwardly and toward the track 100 and from FIGS. 7 and 9 of the drawings, it may be seen that the microphones include overlapping areas of reception. Further, the cam lobe 52 is operative to actuate the sounding body 76 one time during each revolution of the wheel 14 and it will be noted that each of the microphones 116 and 118 is arranged so as to be capable of receiving a signal from the sounding body 78 through a full rotation of the wheel 14, the horizontal linear distance traveled by the assembly 12 during a full rotation of the wheel 14 comprising the distance between the vertical planes A and B illustrated in FIG. 7. Further, it will be noted that each of the zones of reception of the microphones 116 and 118 overlap with the zone of reception of the microphone 120 at the elevation C of the sound generator 18 as the latter passes through the plane B.

Figure 10:
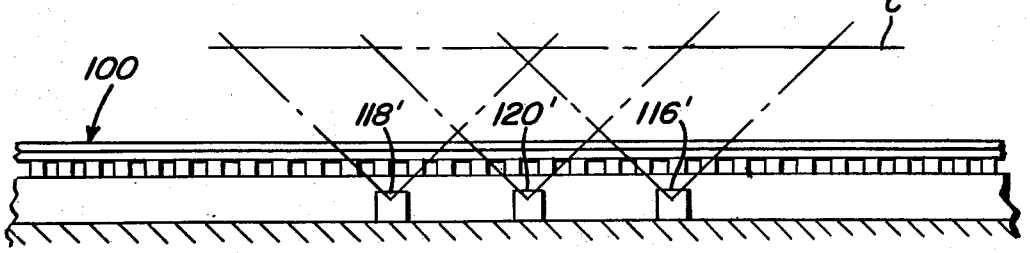
FIG. 10 is a fragmentary side elevational view similar to FIG. 7 but illustrating a modified form of the trackside installation.

With reference now more specifically to FIG. 10 of the drawings, it may be seen that the three microphones 116, 118 and 120 of each installation 102 may be replaced by individual microphones 116', 118', 120' spaced slightly along the track 100.

With attention now invited more specifically to FIG. 12 of the drawings, when the receiver 112 in the caboose is actuated by one of the track-side installations 102, it is operable to actuate both a visual signal 124 and an audible signal 126 and to thereafter, through a variable time delay mechanism 128, actuate an electrically controlled switch 130 for electrically actuating a dump valve 132 interposed in the air brake system 134 of the train.

Further, and with attention directed now more specifically to FIG. 13, when the receiver 114 is actuated by one of the trackside installations 102, it is also capable of electrically energizing visual and audible signals 130 and 132 as well as a switch 134, through a variable time delay 136, for electrically actuating a relay 138 in electrical connection with the electrical control for the power system of the train engine.

Should the receiver 112 be actuated and the visual and audible signals 124 and 126 be noted by a trainman in the caboose, that trainman then contacts the engineer of the train by a separate on-board communication system in order to notify the engineer of a hot box condition. Further, if the signals 130 and 132 are noted upon actuation of the engine cab mounted receiver 114, the engineer is automatically notified of a hot box condition. However, if appropriate action to bring the train to a halt is not taken within a predetermined time interval after actuation of the receiver 112, the switch 130 is actuated through the variable time delay 128 and the electrically actuated dump valve 132 of the air brake system is automatically opened in order to bring the train to a halt. Further, if for any reason the caboose receiver is rendered inoperative and the actuation of the visual and audible signals 130 and 132 are unnoticed in the cab of the engine, after a predetermined time interval, the switch 134 is actuated through the variable time delay 136 and the relay 138 is actuated thorugh the switch 134 in order to automatically shut down the power system of the engine. Therefore, the train may be automatically brought to a halt by two different train board receivers and the two train board receivers may be actuated by the next trackside installation 102 in the event the first installation 102 pass by an operating sound generator 118 is for some rendered inoperative. In this manner, a substantially fail-safe system is provided.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a railroad track section having a railway train thereon including distant interconnected engine and caboose components, at least one normally deactuated and heat actuatable signal generating means mounted on a wheeled component of said train intermediate said engine and caboose in heat transfer relation with a wheel bearing means of said intermediate wheeled component, a trackside signal receiver capable of receiving a signal generated by said signal generating means as the latter passes in close proximity to said trackside signal receiver, a trackside radio signal transmitter operatively associated with said receiver to transmit a predetermined low magnitude radio signal in response to said receiver receiving a signal from said signal generator, a radio signal receiver mounted in each of said engine and caboose components for receiving said low magnitude radio signal, and trainmen warning signal generating means operatively associated with each of said radio signal receivers for rendering a warning signal in response to the corresponding radio signal receiver receiving said predetermined radio signal from said trackside transmitter, said wheeled component including an axle assembly having opposite end wheels mounted thereon, the opposite end portions of said axle assembly being journalled from said wheel bearing means, said signal generating means being mounted on one end portion of said axle assembly for rotation therewith.

2. The combination of claim 1 wherein said signal generating means includes a first portion stationarily mounted on one of said axle assembly end portions for rotation therewith, a second portion mounted on said first portion for rotation relative to the latter about an axis generally coinciding with the axis of rotation of said axle assembly, coacting sound producing means carried by said first and second portions operative to generate cyclic sound signals in response to relative rotation of said first and second portions, weight means shiftably supported from said second portion for shifting between first and second positions thereon in which said second portion is at least generally balanced relative to the axis of rotation of said second portion relative to said first portion and eccentrically weighted relative to the last mentioned axis, respectively, means connected between said weight means and said second portion yeildingly biasing said weight means toward said second position and heat deactuatable means releasably retaining said weight means in said first position.

3. The combination of claim 2 wherein said weight means and first portion includes coacting latch means engaged with each other when said weight means is in said first position locking said portions against relative rotation and free from engagement with each other when said weight means is in said second position for free relative rotation between said first and second portions.

4. The combination of claim 2 wherein said weight means comprises a cover for said coacting sound producing means operative to fully enclose the latter when said weight means is in said first position and shifted to a position with said coacting sound producing means at least substantially fully exposed when said weight means is in said second position.

5. In combination with a journalled axle assembly end subject to increases in temperature as a result of a heated bearing condition, signal generating means including a first portion mounted on said axle assembly end portion for rotation therewith, a second portion mounted on said first portion for rotation relative to the latter about an axis generally coinciding with the axis of rotation of said axle assembly and coacting sound producing means carried by said first and second portions operative to generate cyclic sound signals in response to relative rotation of said first and second portions, weight means shiftably supported from said second portion for shifting between first and second positions thereon in which said second portion is at least generally balanced relative to the axis of rotation of said second portion relative to said first portion and eccentrically weighted relative to the last mentioned axis, respectively, means connected between said weight means and said second portion yieldingly biasing said weight means toward said second position, and heat deactuatable means releasably retaining said weight means in said first position.

6. The combination of claim 5 wherein said weight means and first portion includes coacting latch means engaged with each other when said weight means is in said first position locking said portions against relative rotation and free from engagement with each other when said weight means is in said second position for free relative rotation between said first and second portions.

7. The combination of claim 5 wherein said weight means comprises a cover for said coacting sound producing means operative to fully enclose the latter when said weight means is in said first position and shifted to a position with said coacting sound producing means at least substantially fully exposed when said weight means is in said second position.

8. In combination with a railroad car equipped with axle mounted sound signal generating means operative to cyclically generate at least one signal each revolution of one axle member of the railway car in response to a "hot box" condition, a railroad track assembly upon which said car is disposed for movement therealong, a trackside sound signal receiving installation, said installation including a sound signal receiver equipped with three sound receiving microphones each having a cone of reception of generally 90°, said microphones being arranged relative to each other and said track assembly with two microphones facing toward the path of the axle of said car and in generally opposite directions along said track and the cones of reception of said two microphones overlapping between said microphones and the adjacent portion of said path, and the third microphone directed toward said path at substantially right angles relative thereto and disposed between said two microphones with the cone reception of said third microphone overlapping the cones of reception of said two microphones between the latter and said path, said signal receiving installation including radio signal transmitting means operatively associated therewith and actuatable thereby for generating a predetermined radio signal for reception by a receiver mounted in the caboose and/or engine of a passing train.

9. The combination of claim 8 wherein each end of said axle is equipped with sound signal generating means, said track assembly having a trackside signal receiving installation on each side thereof.

10. The combination of claim 8 wherein said track assembly includes a pair of conductive rail sections, said rail sections having low amplitude current supplied thereto for Centralized Train Control System monitoring, said trackside signal receiver being electrically connected to said rail sections for powering by said low amplitude current.

11. In combination with a railroad car equipped with axis mounted sound signal generating to cyclically generate at least one signal each revolution of one axle member of the railway car in response to a "hot box" condition, a railroad track assembly upon which said car is disposed for movement therealong, a trackside sound signal receiving installation, said installation including a sound signal receiver equipped with three sound receiving microphones each having a cone of reception of generally 90°, said microphones being spaced along said track assembly and arranged relative to each other and said track assembly with each microphone facing toward the path of the axle of said car at substantially right angles relative thereto and with the cones of reception of said microphone overlapping the cones of reception of the other microphones between the latter and said path.

12. The combination of claim 11 wherein said track assembly includes a pair of conductive rail sections, said rail sections having low amplitude current supplied thereto for Centralized Train Control System monitoring, said trackside signal receiver being electrically connected to said rail sections for powering by said low amplitude current.

13. In combination with a railroad car axle end, warning signal generating means carried by said axle end, a cover mounted on said axle end and shiftable relative thereto between open and closed positions exposing and closing said signal generating means, means yieldingly biasing said cover toward said open position, and axle heat sensing latch means releasably latching said cover in the closed position and operative in response to being subject to heat above a predetermined temperature to release said cover for movement of the latter toward its open position, said cover serving to at least substantially entirely enclose said signal generating means when said cover is in the closed position.

14. The combination of claim 13 wherein said signal generating means is disposed in axial registry with said axle end.

* * * * *